US006100484A

United States Patent [19]

Houze et al.

[11] Patent Number: 6,100,484

[45] Date of Patent: Aug. 8, 2000

[54] ELECTRICAL SWITCH WITH INSERT-MOLDED CIRCUITRY

[75] Inventors: Emmanuel Houze, Argentre du Plessis; Dominique Jean Denis Bertho, Saint Fort, both of France

[73] Assignee: Molex Incorporated, Lisle, Ill.

[21] Appl. No.: 08/975,962

[22] Filed: Nov. 21, 1997

[30] Foreign Application Priority Data

Jul. 23, 1997 [EP] European Pat. Off. ..... 97112620

[51] Int. Cl.[7] ..... H01H 13/52

[52] U.S. Cl. ..... 200/512; 200/284

[58] Field of Search ..... 200/512, 284, 200/202, 292; 361/813

[56] References Cited

U.S. PATENT DOCUMENTS

| | | | |
|---|---|---|---|
| 3,860,771 | 1/1975 | Lynn et al. . | |
| 3,968,336 | 7/1976 | Johnson | 200/5 A |
| 4,128,744 | 12/1978 | Seeger . | |
| 4,146,767 | 3/1979 | Murata | 200/159 B |
| 4,243,861 | 1/1981 | Strandwitz | 200/159 B |
| 4,359,614 | 11/1982 | Green | 200/5 R |
| 4,501,938 | 2/1985 | Kawauchi . | |
| 4,564,832 | 1/1986 | Inoue | 234/365 R |
| 4,598,794 | 7/1986 | Sugiura et al. | 403/187 |
| 4,767,896 | 8/1988 | Nigg et al. | 200/67 DA |
| 4,894,498 | 1/1990 | Kagawa et al. | 200/284 |
| 4,944,908 | 7/1990 | Leveque et al. . | |
| 5,085,462 | 2/1992 | Gualtier | 280/731 |
| 5,108,295 | 4/1992 | Koike et al. | 439/79 |
| 5,197,184 | 3/1993 | Crumly et al. . | |
| 5,199,555 | 4/1993 | Hirano | 200/341 |
| 5,264,730 | 11/1993 | Matsuzaki et al. | 257/787 |
| 5,313,027 | 5/1994 | Inoue et al. | 200/5 A |
| 5,399,823 | 3/1995 | McCusker | 200/521 |
| 5,842,561 | 12/1998 | Takahashi | 200/406 |
| 5,844,184 | 12/1998 | Liau | 200/16 R |
| 5,860,513 | 1/1999 | Suzuki | 200/268 |

FOREIGN PATENT DOCUMENTS

| | | | |
|---|---|---|---|
| 340116 A2 | 4/1988 | European Pat. Off. | H01R 43/24 |
| 322515 A2 | 9/1988 | European Pat. Off. | H01H 13/70 |
| 332866 A2 | 2/1989 | European Pat. Off. | H01R 43/16 |
| 387845 A1 | 3/1990 | European Pat. Off. | H05K 7/02 |
| 3284111 | 3/1990 | Japan | H02G 3/16 |

*Primary Examiner*—Renee Luebke
*Attorney, Agent, or Firm*—James C. Paschall

[57] ABSTRACT

An electrical switch includes a generally planar, generally stiff dielectric substrate. Stamped sheet metal circuitry is engaged to at least one side of the substrate and includes an open circuit portion. A layer is juxtaposed over the circuitry and includes at least one contact area on a side of the layer in facing relation with the open circuit portion. Therefore, movement of the layer toward the substrate is effective to move the contact area and close the open circuit portion. Preferably, the dielectric substrate is insertmolded about the stamped circuitry. The circuitry includes bent spring beams for mounting to appropriate conductors. The invention also contemplates a method of fabricating the electrical switch as well as a circuit frame incorporating the stamped circuitry and the insert-molded substrate.

5 Claims, 5 Drawing Sheets

ELECTRICAL SWITCH WITH INSERT-MOLDED CIRCUITRY

FIELD OF THE INVENTION

This invention generally relates to the art of electrical circuitry and, particularly, to circuitry adapted for use in electrical switches, such as membrane switches.

BACKGROUND OF THE INVENTION

Flexible circuitry is used in a wide variety of applications to provide electrical conductor paths. For instance, flexible circuitry has been used in electrical switches, such as membrane switches.

Generally, a flexible circuit is formed by a sheet or layer of flexible film, such as polyester film, having an electrical circuit or conductor pattern on at least one side thereof. For instance, the electrical circuit may be an inked conductor pattern. Typically, the flexible circuit is adhered to some form of stiffener or more rigid backing substrate to provide support for the flexible circuit. In other words, to support the flexible circuit in use, such as in a switch, a supporting structure must be used to prevent the flexible component from bending or collapsing. Moreover, such flexible circuits must be electrically linked to an electrical device by a connector or heat seal connection.

An example of an electrical switch in which flexible circuitry is used is in the area of membrane switches. Such a switch often includes a generally planar stiffener or substrate to which a flexible circuit is adhered. One side of the flexible film of the circuit is adhered to the stiffener, and the opposite side has a circuit pattern, including an open circuit portion, printed thereon. In some instances, the stiffener may be provided with formed or bent spring beams to engage appropriate circuit traces on a printed circuit board. The flexible circuit has an area with circuit terminal portions on the bent spring beams for electrical connection to the traces on the printed circuit board. A top layer typically made of insulating material is provided over the flexible circuit and includes a contact area on a side of the layer in facing relation with the open circuit portion of the circuit pattern on the flexible circuit. Movement of the top layer toward the flexible circuit is effective to move the contact area and close the open circuit portion. A spacer layer may be provided between the top layer and the flexible circuit, except between the contact area and the open circuit portion, to normally maintain the switch in open condition. In such a structure, the top layer does not have to be made of insulative material.

"Referring to the drawings in greater detail, and first to FIGS. 1–4, a membrane switch, generally designated 12, is shown in accordance with the prior art. The switch includes four major components, namely: a stiffener 14; a flexible circuit, generally designated 16; a spacer layer 18; and an actuator layer 20. These components are assembled together in sort of a lamination as seen best in FIGS. 3 and 4.

More particularly, stiffener 14 of prior art switch 12 is a simple planar metal sheet of a rectangular configuration having a plurality of spring beams 22 bent or formed out of the sheet. As seen in FIGS. 3 and 4, the distal ends of spring beams 22 have feet portions 22*a* for biasing toward a printed circuit board (not shown) in the direction of arrows "A".

Flexible circuit 16 of prior art switch 12 includes a flexible film 24, such as of polyester material. The film is rectangularly shaped to the same dimensions as stiffener 14, whereby a back side 24*a* of the film can be adhered, as by an appropriate adhesive, to the front face of the stiffener. A given pattern of conductors 26 is printed or inked onto the front face 24*b* of flexible film 24, i.e. on the side of the film opposite to side 24*a* which is adhered to stiffener 14. The printed conductors define a circuit pattern having a pair of open circuit portions 26*a*. The printed conductors also include terminal portions 26*b* extending to an edge of a tongue portion 24*c* of film 24. As seen best in FIGS. 3 and 4, tongue portion 24*c* is wrapped around the outside of spring beams 22 of stiffener 14 so that terminal portions 26*b* (FIG. 1) of the circuitry is in position to engage the circuit traces on the printed circuit board, as at arrows "A".

Spacer layer 18 of prior art switch 12 is adhered, as by an appropriate adhesive, to the front face of flexible circuit 16. The spacer layer substantially covers the printed circuit pattern 24 on the flexible circuit except for holes 28 in the spacer layer which expose open circuit portions 26*a* of the printed circuitry. Spacer layer 18 is rectangularly shaped and of the same dimensions as stiffener 14 and flexible circuit 16, except that the lower edge of the spacer layer is provided with a cutout 30 to accommodate spring beams 22 of the stiffener.

Actuator layer 20 of prior art switch 12 is adhered, as by an appropriate adhesive, to the front face of spacer layer 18. Again, the actuator layer is generally rectangular and of the same dimensions as the spacer layer, the flexible circuit and the stiffener, except for a cutout 32 aligned with cutout 30 in the spacer layer to accommodate spring beams 22. Actuator layer 20 may be fabricated of an insulative material such as polyester film. However, if the space layer 18 is made of an insulative material, the actuator layer 20 may be made of a conductive material. The actuator layer 20 includes formed or embossed "domes" 34, which project outwardly of the plane of the actuator layer 20. As seen in FIG. 4, a contact area in the form of a conductive ink pad 36 is printed to the concave inside of each dome 34. Each dome and its respective conductive pad 36 is aligned with a respective one of the holes 28 in spacer layer 18 which, in turn, is aligned with a respective one of the open circuit portions 26*a* of printed circuitry 26 on flexible circuit 16. It should be noted that the actuator layer 20 and spacer layer 18 can be replaced by metal domes, silicone membranes or any other device which functions to connect the open circuit portions 26*a*.

In the normally open condition of prior art switch 12, domes 34 and conductive pads 36 are spaced away from open circuit portions 26*a* as best seen in FIG. 4. When it is desired to close one or both of the switches, pressure is applied to one or both of the domes in the direction of arrows "B" (FIGS. 3 and 4) which moves conductive pad(s) 36 into engagement with open circuit portion(s) 26*a* to close the circuit therethrough."

One of the problems with switches or other electrical products using flexible circuitry in a structural combination generally as described above, is that the flexible circuit has a tendency to become delaminated from the stiffener or rigid backing substrate. Additionally, the inked circuit pattern tends to rub off the flexible circuit. This is particularly true when the stiffener has three-dimensional or formed portions about which the flexible circuitry conforms, such as the bent spring beams described above. Moreover, tolerances associated with assembling the amorphous flexible circuit to the stiffener can be very large because of the imprecision inherent in such an assembly. The present invention is directed to solving these problems in such items as electrical switches by eliminating the use of flexible circuitry yet providing similar advantages.

SUMMARY OF THE INVENTION

An object, therefore, of the invention is to provide a new and improved electrical circuit structure for use in various electrical products, such as electrical switches and, particularly, membrane switches.

In the exemplary embodiment of the invention, an electrical switch is disclosed which integrates the switch and a connector between the switch and an electric device. The switch has a generally planar, generally stiff dielectric substrate. Stamped sheet metal circuitry is juxtaposed on at least one side of the substrate and includes an open circuit portion. A top layer is juxtaposed over the circuitry and includes at least one contact area on a side of the layer in facing relation with the open circuit portion, whereby movement of the top layer toward the substrate is effective to move the contact area and close the open circuit portion.

As disclosed herein, the dielectric substrate is insert-molded about the circuitry. Preferably, the stamped sheet metal circuitry is generally coplanar with the one side of the planar dielectric substrate. The stamped circuitry may slightly protrude above the one side of the dielectric substrate in the contact area. A spacer layer is disposed between the insulating layer and the stamped circuitry except between the contact area and the open circuit portion.

The above electrical switch is shown herein as mounted generally perpendicular to a printed circuit board. The stamped sheet metal circuitry includes terminal portions formed out of the plane of the generally planar dielectric substrate. The terminal portions are formed for engaging appropriate circuit traces on the printed circuit board.

The invention also contemplates a method of fabricating an electrical switch with the above construction as well as a circuit frame incorporating the stamped sheet metal circuitry insert-molded on the planar dielectric substrate.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 10:
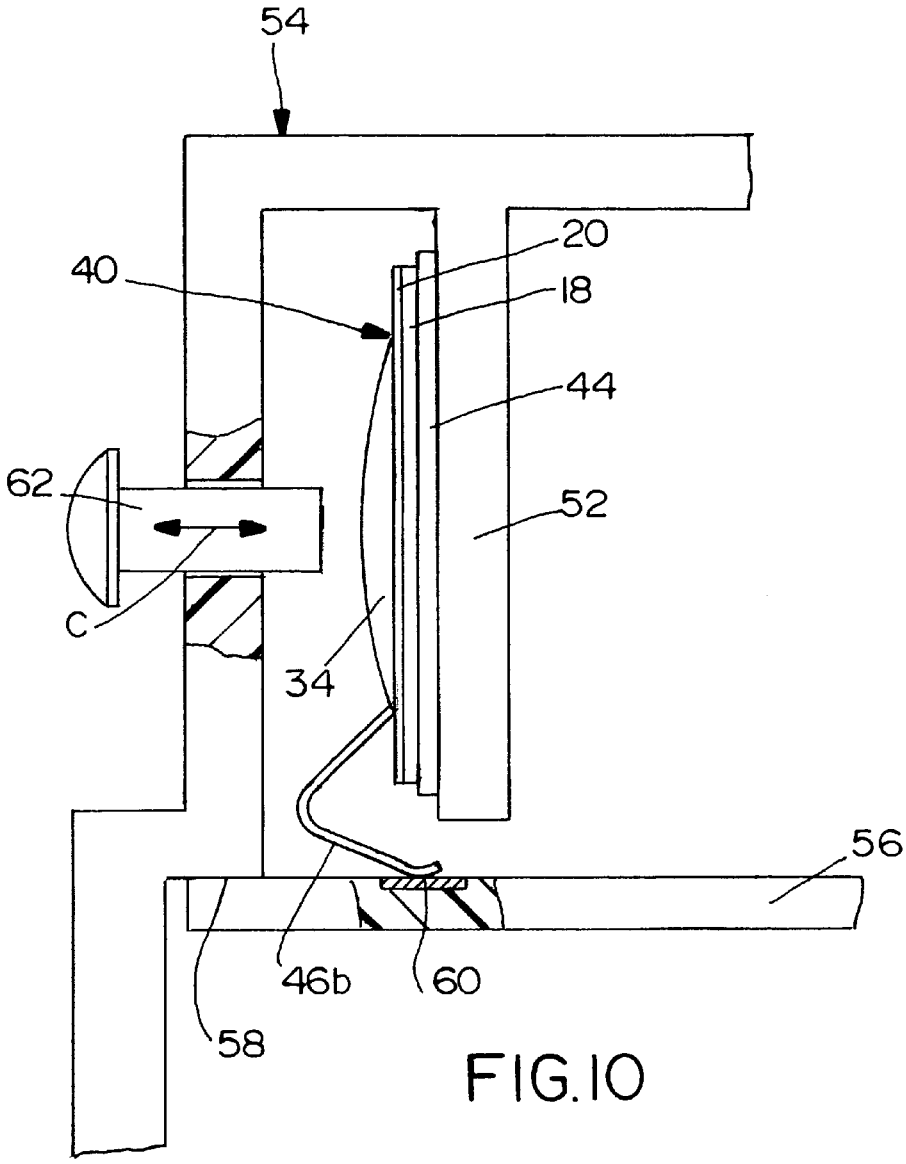
FIG. 10 is an elevational view, partially in section, showing the switch of FIGS. 5–8 mounted by a support structure generally perpendicular to a printed circuit board.

Referring to the drawings in greater detail, FIGS. 1–4 show an electrical switch embodying the concepts of the prior art. FIGS. 5–9 show a switch embodying the concepts of the present invention. FIG. 10 shows the switch of the present invention mounted and supported for use in conjunction with a printed circuit board.

As stated in the "Background", above, one of the problems with prior art switches as described in relation to FIGS. 1–4, is that flexible circuit 16 is prone to delaminate from stiffener 14. This is particularly true in the area of spring beams 22 where the flexible circuit must conform to three-dimensional shapes.

FIGS. 5–9 show an electrical membrane switch, generally designated 40, according to the concepts of the present invention. More particularly, switch 40 includes a circuit frame, generally designated 42, along with the spacer layer 18 and the actuator layer 20. Spacer layer 18 and actuator layer 20 are substantially identical to the spacer layer and actuator layer described above in relation to prior art switch 12 and, therefore, the details of the structure of these two components will not be repeated, and like reference numerals have been applied as in the description above.

According to the invention, circuit frame 42 of switch 40 includes a generally planar, generally stiff dielectric substrate 44. The substrate is of a moldable material, such as plastic or the like. Stamped sheet metal circuitry, generally designated 46, is insert-molded in a front face or side of dielectric substrate 44.

In particular, stamped sheet metal circuitry 46 includes a plurality of stamped conductors 46*a* which have distal ends bent or formed to define terminal portions 46*b* projecting from a notch 48 molded at a bottom edge of substrate 44. It can be seen that terminal portions 46*b* of stamped conductors 46*a* in the preferred embodiment are bent or formed in the configuration of spring beams 22 of prior art switch 12. Stamped circuitry 46 includes a pair of open circuit portions 46*c* which are aligned with holes 28 in spacer layer 18 and domes 34 of actuator layer 20. It is, however, contemplated that the stamped circuitry 46 could include more or less than two open circuit portions 46*c*.

Figure 1:
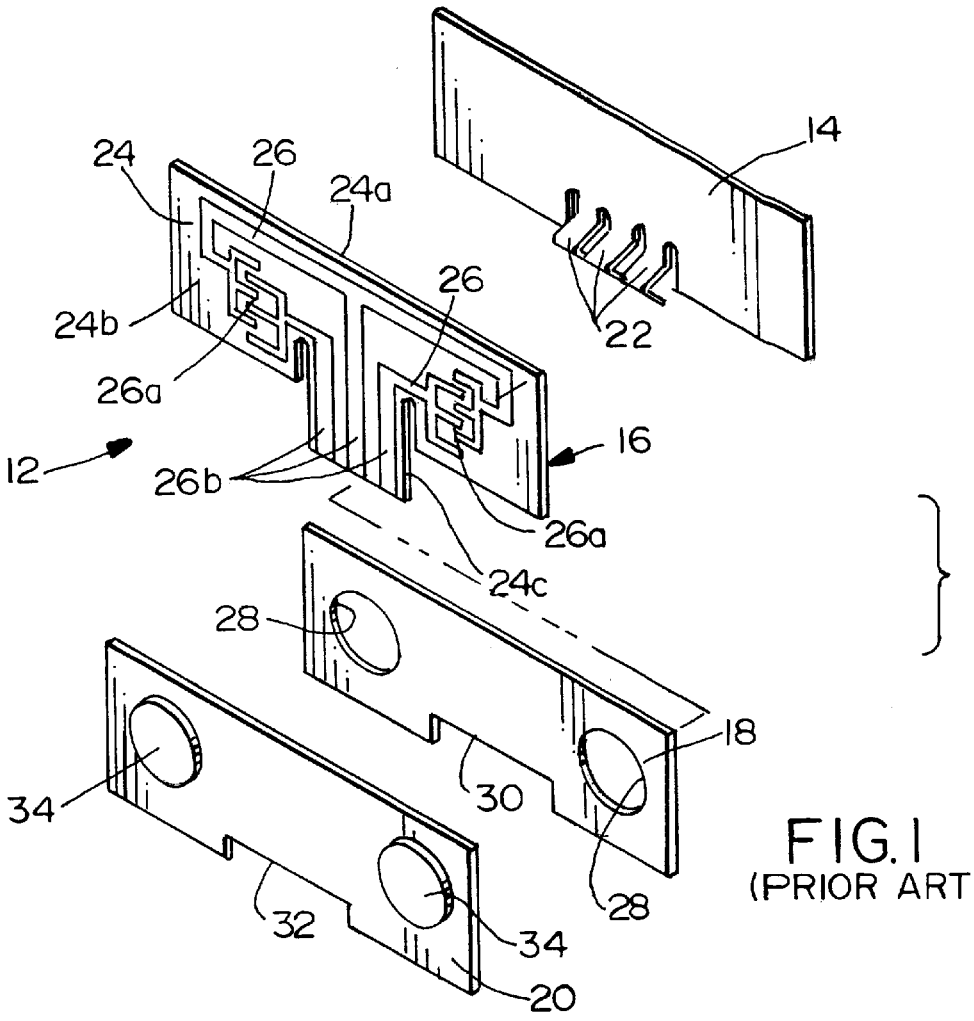
FIG. 1 (PRIOR ART)
FIG. 1 is an exploded perspective view of the components of a membrane switch according to the concepts of the prior art.
Figure 2:
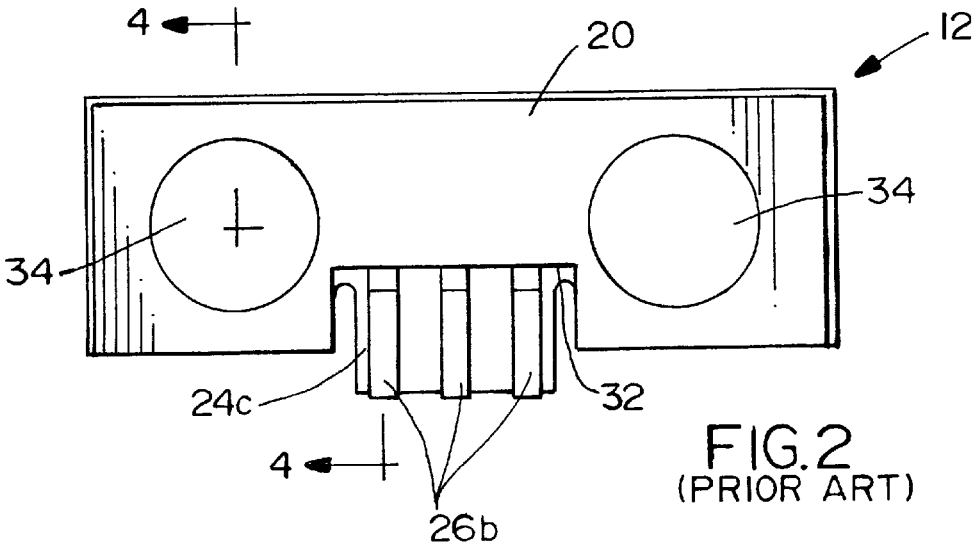
FIG. 2 (PRIOR ART)
FIG. 2 is a front elevational view of the prior art switch.
Figure 4:
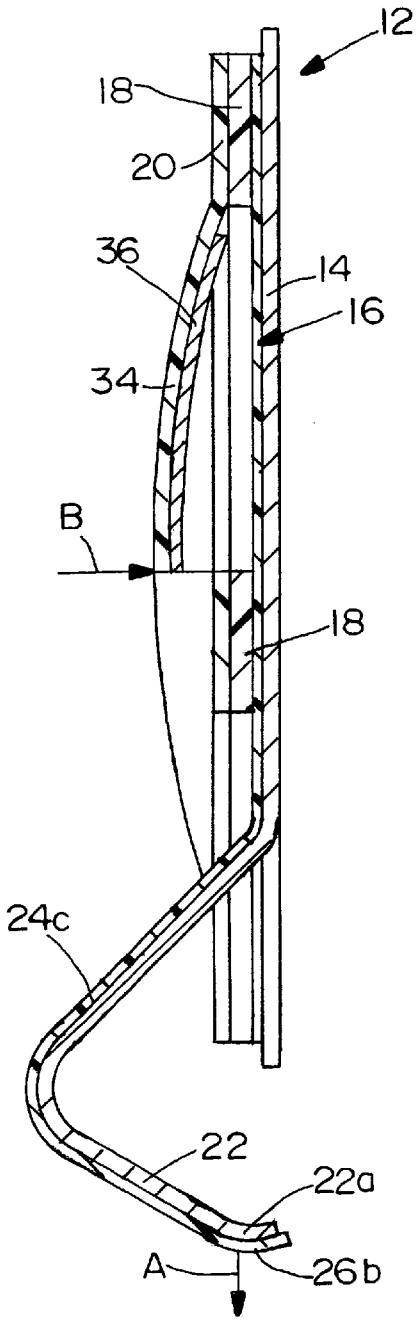
FIG.4 (PRIOR ART)
FIG. 4 is a section taken generally along line 4—4 of FIG. 2.
Figure 3:
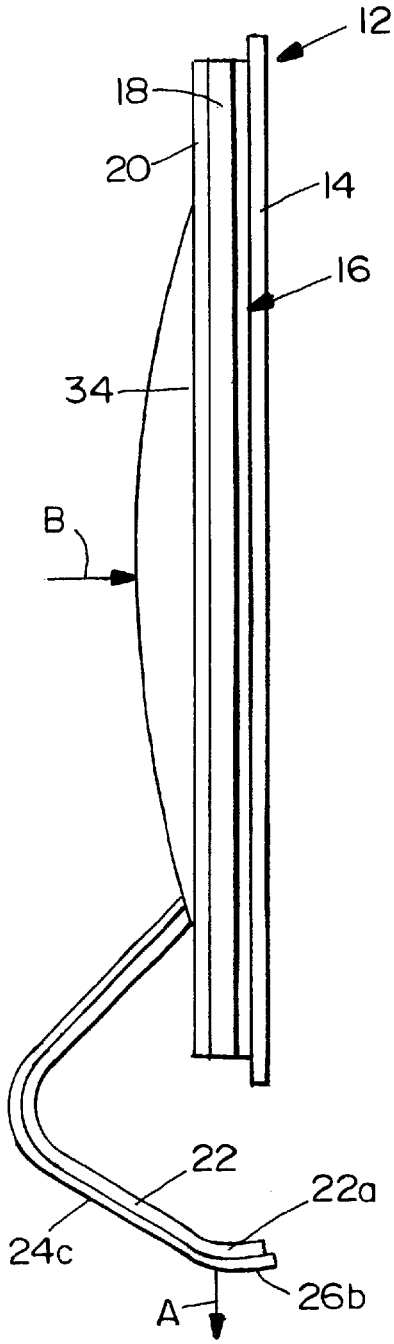
FIG.3 (PRIOR ART)
FIG. 3 is a side elevational view of the prior art switch.
Figure 5:
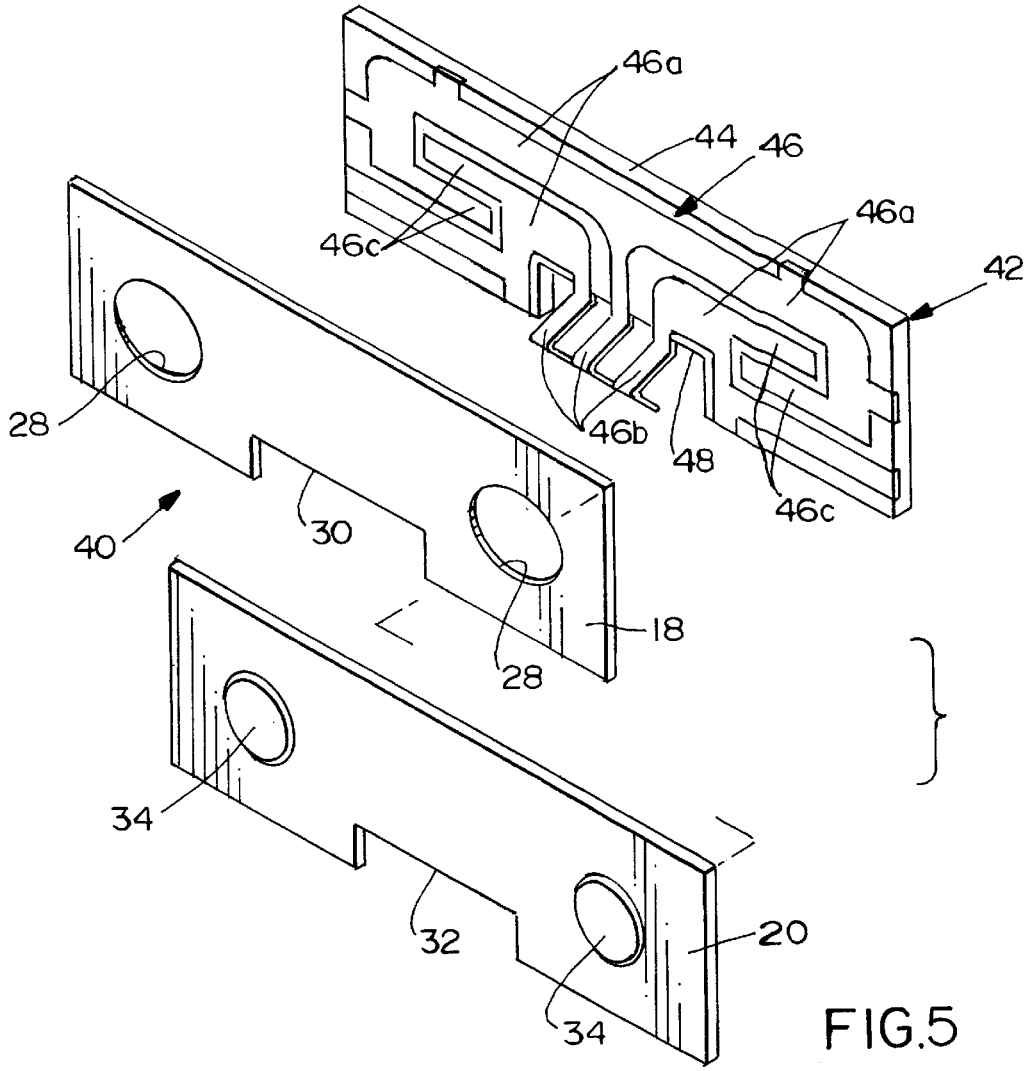
FIG. 5 is an exploded perspective view of the components of a switch incorporating the concepts of the invention.
Figure 6:
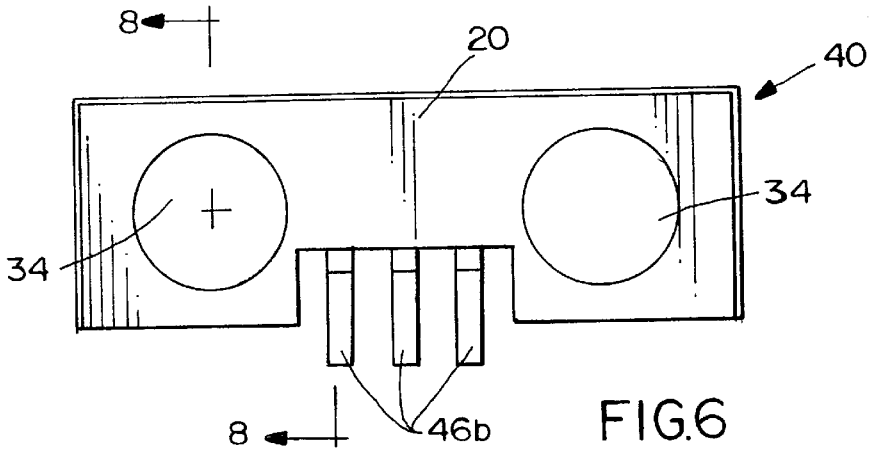
FIG. 6 is a front elevational view of the switch of FIG. 5.
Figure 8:
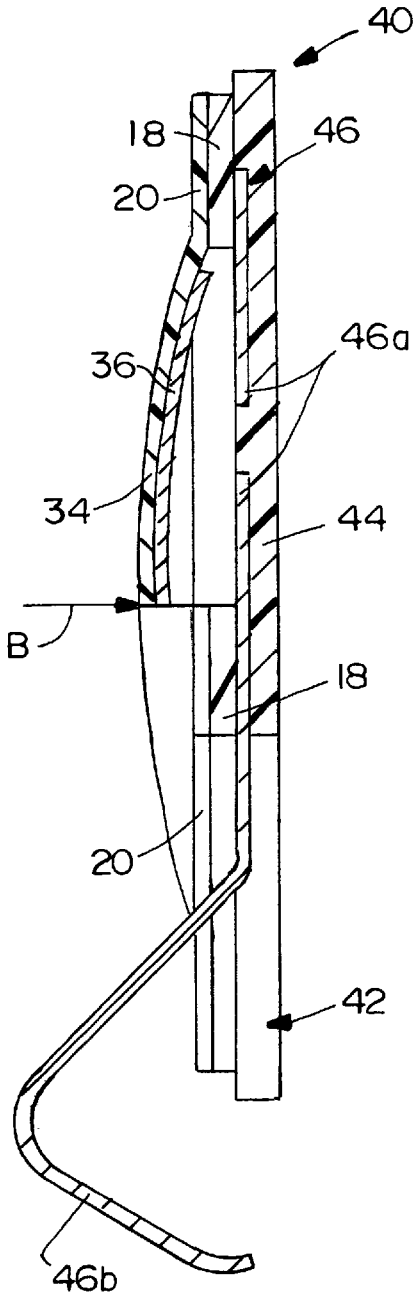
FIG. 8 is a section taken generally along line 8—8 of FIG. 6.
Figure 7:
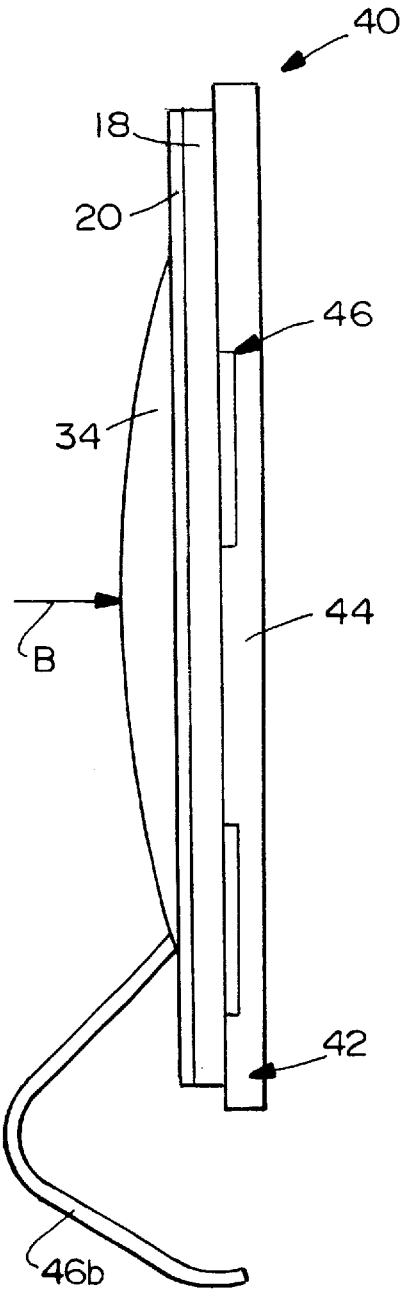
FIG. 7 is a side elevational view of the switch of FIG. 5.

In fabrication, a simple rectangular mold is provided in the shape of dielectric substrate 44, and stamped sheet metal circuitry 46 is supported at the top edge of the mold by an appropriate fixture. Molten plastic material then is injected into the mold cavity so that the material is insert-molded about the back side and edges of stamped circuitry 46 as best seen in FIG. 5. Therefore, the front exposed face of stamped circuitry 46 is maintained generally coplanar or flush with the front face or surface of planar dielectric substrate 44. However, it may be desired to conduct the molding so the open circuit portions 46*c* of the stamped circuitry 46 protrude slightly above the front face of the dielectric substrate 44 to ensure contact upon actuation. Additionally, the dielectric substrate can be molded into any desired shape and integrate features such as retention clips or positioning members for use to facilitate assembly.

Figure 9:
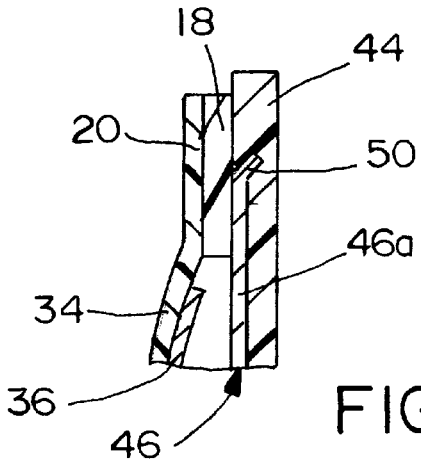
FIG. 9 is a fragmented section through an edge portion of one of the conductors of the stamped sheet metal circuitry showing how the edge is embedded in the insert-molded dielectric substrate.

To ensure that the conductors 46*a* of the stamped circuitry 44 are securely retained in the dielectric substrate 44, edges of the stamped circuitry 46 may be provided with surfaces which are embedded under the surface of the substrate 44. The circuitry 46 can be provided with nonvertical, angular surface portions which embed in the substrate 44 under the surface thereof during insert-molding. For example, as seen in FIG. 9, tabs 50 may be bent out of conductors 46*a* of stamped circuitry 46 so that the tabs are embedded in the insert-molded dielectric substrate 44. This secures the stamped circuitry and assists in eliminating any delamination problems. The bent tabs can be provided at spaced or continuous locations along the conductors and terminal portions of the stamped circuitry, as needed. Other nonvertical, angular surfaces are obtained by providing the stamped circuitry 46 with tapered edges (not shown), so the conductor 46*a* has trapezoidal cross section. Alternatively, the stamped circuitry 46 could be provided with extensions (not shown) along the edges thereof which are fully embedded in the substrate 44.

FIG. 10 shows switch 40 of the invention mounted on a vertical portion 52 of a support structure, generally designated 54, so that the switch lies in a plane generally perpendicular to a printed circuit board 56. The switch 40 can also be mounted in one of several other varieties of angular relationships with respect to the printed circuit board 56. Moreover, the switch 40 can be mounted to a circuit member other than a printed circuit board, such as a membrane circuit. The circuit board 56 is mounted to and supported by the support structure, as at 58. The circuit board includes appropriate circuit traces 60 for engagement by terminal portions 46*b* of stamped sheet metal circuitry 46. Accordingly, the switch 40 can be connected to the circuit board 56 without requiring an additional connector or a heat seal connector because the switch 40 and the connector 46*b* are integrated. A push button 62 may be reciprocally mounted in support structure 54 for each dome 34 and corresponding open circuit portion 46*c* of switch 40. The push button is reciprocally movable in the direction of double-headed arrow "C". An appropriate spring arrangement could be provided to bias the push button toward an outer, inoperative position. This overall supporting structure is shown to illustrate one application of switch 40 of the invention. Although it is not shown, it should be understood that terminal portions 46*b* can be configured to contact traces 60 not just on the top surface of the printed circuit board 56 but on the bottom surface, side surface or a plated through-hole surface in the printed circuit board 56.

FIG. 10 shows that terminal portions 46*b*, being integral portions of stamped sheet metal circuitry 46, can be spring-loaded into a preloaded condition against circuit traces 60 of printed circuit board 56. An example of an appropriate conductive, metal material from which stamped circuitry 46 can be fabricated is a phosphor bronze material. The distal ends or feet of terminal portions 46*b* easily can be gold or otherwise plated for engaging circuit traces 60 on circuit board 56 with reduced resistance. It can be understood that stamped sheet metal circuitry 46 is substantially more durable than the flexible circuit 16 of prior art switch 12. Accordingly, the terminal portions 46*b* will not lose conductivity thereby improving over the conductive ink traces 26*b* of the prior art switch 12 which tend to rub off the flexible circuit 24. In addition, all of the delamination problems of the flexible circuit of the prior art, particularly in the area of adhering the flexible circuit to spring beams 22 of stiffener 14, are eliminated by the circuit frame 42 of the invention. Furthermore, insert-molding tolerances associated with locating the stamped circuitry 46 with respect to the circuit frame 42 are very low and substantially better than those inherent in assembling the flexible circuit 24 to the stiffener 14 of the prior art.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A switch circuit frame, comprising:

a generally planar dielectric substrate including at least one generally planar side;

stamped sheet metal circuitry on said one side of the substrate and including a plurality of conductors in a given circuit pattern defining a contact area; and wherein portions of said circuitry are embedded in said dielectric substrate leaving an exposed face of the contact area of the stamped sheet metal circuitry generally coplanar with said one side of the planar dielectric substrate and bent spring beams extending from a notch in an edge of said substrate for providing terminal portions for connection to circuit traces on a circuit board, said notch having three sides each extending generally perpendicularly to said one generally planar side of said dielectric substrate.

2. The circuit frame of claim 1 wherein said stamped sheet metal circuitry includes terminal portions formed out of the plane of the generally planar dielectric substrate.

3. The circuit frame of claim 1 wherein said terminal portions are formed for engaging appropriate circuit traces on a printed circuit board disposed generally perpendicular to the substrate.

4. The circuit frame of claim 1 wherein portions of an exposed face of the stamped sheet metal circuitry slightly protrude above the planar dielectric substrate.

5. The circuit frame of claim 1 wherein edges of the stamped circuitry include portions embedded in the substrate.

* * * * *